United States Patent [19]

Schedele

[11] Patent Number: 4,527,138

[45] Date of Patent: Jul. 2, 1985

[54] ELECTROMAGNETIC ROTATING ARMATURE RELAY

[75] Inventor: Helmut Schedele, Diessen, Fed. Rep. of Germany

[73] Assignee: Siemens Aktiengesellschaft, Berlin & Munich, Fed. Rep. of Germany

[21] Appl. No.: 586,988

[22] Filed: Mar. 7, 1984

[30] Foreign Application Priority Data

Apr. 27, 1983 [DE] Fed. Rep. of Germany ..... 3315168

[51] Int. Cl.[3] ..... H01H 51/27

[52] U.S. Cl. ..... 335/81; 335/78; 335/202

[58] Field of Search ..... 335/78–85, 335/202

[56] References Cited

U.S. PATENT DOCUMENTS 3,946,347 3/1976 Sauer ..... 335/78

FOREIGN PATENT DOCUMENTS 3225830 1/1984 Fed. Rep. of Germany .

*Primary Examiner*—E. A. Goldberg
*Assistant Examiner*—George Andrews
*Attorney, Agent, or Firm*—Hill, Van Santen, Steadman & Simpson

[57] ABSTRACT

The improved relay includes two hollow coil bodies which are in axial alignment on a common base. A beam rotating armature extends through the inside of the coil bodies in the axial direction. A bearing element composed of an insulating material is provided in the central portion of the armature, the bearing element including center contact springs which are embedded parallel to the armature. By means of the bearing element, the armature is embedded by means of neck portions in the base and in a sole plate which connects the two coil bodies. The two ends of the armature form working air gaps with a pair of yokes, the yokes being angularly positioned and being actuated by two permanent magnets which lie above the coil bodies.

6 Claims, 5 Drawing Figures

ELECTROMAGNETIC ROTATING ARMATURE RELAY

BACKGROUND OF THE INVENTION

1. Field of the Invention

This invention is in the field of electromagnetic rotating armature relays utilizing two single coil bodies disposed axially, the coil bodies being positioned on the base by means of seating surfaces, the armature being combined with a bearing element which extends between the base of the relay and a sole plate.

2. Description of the Prior Art

This improvement is particularly directed to the type of structure described in German Application No. P 32 25 830.5. This published application describes a relay which has a coil member having a center flange located between two axially offset windings. In the vicinity of the center flange, there is a rod-shaped rotating armature which is axially mounted within the coil member by means of a bearing element. Extensions on the bearing element project radially from the coil member through lateral openings of the center flange to actuate rigidly coupled contact springs.

This relay structure with its rotating armature system is very beneficial magnetically. The center contact springs are directly coupled to the armature so the structure is well suited for a relay having four changeover contacts. With a one-piece coil body as disclosed in the aforementioned German application, however, it is relatively difficult to introduce the separately fabricated bearing element into the center flange and to connect it to the armature and to the contact springs as required. Tolerances which exist require a substantial adjustment, not only increasing the manufacturing time and cost but also deteriorating the quality of the relay.

SUMMARY OF THE INVENTION

The present invention provides an improvement of the relay described in German Ser. No. P 32 25 830.5 in such a manner that the basic format is retained and the manner of functioning of the relay is retained but tolerances are reduced so that a simpler manufacture and assembly of the component parts are achieved as well as a more consistent performance.

In accordance with the present invention, the coil body is formed by two single coil bodies disposed axially behind one another and provided with windings, the coil bodies being positioned on a common base portion by means of seating surfaces. The center flange accepting the bearing element of the armature is formed by the body of the base on the one side and by a sole plate bridging the two subcoil bodies on the other.

In comparison to the forms of the invention shown in the German application, there is no longer a single, one-piece coil body in the relay according to the present invention which acts as a carrier for the armature and for the center contact springs connected to the armature. Instead, the base body forms a pivot bearing for the armature. Since the cooperating contact elements are also anchored in the base body, significantly fewer close tolerances exist between the armature and the center contact springs connected to the armature as well as the cooperating contact elements. The two single coil bodies are likewise individually positioned on the base body and additionally connected to one another by means of the sole plate for the armature. They require no close tolerances that could interfere with the function of the armature and of the contact elements.

By dividing the coil body into two separately mountable single coil bodies, it is possible to connect the armature to the bearing element before assembly, for example, by means of extrusion coating, and thereby also secure the center contact springs with precision relative to the armature by means of injection. Bearing neck portions can then likewise be attached with high precision during the extrusion coating.

Additional tolerances can also be eliminated in that the yokes can be positioned in recesses or positioning spacers of the base body to define the working air gaps between the yokes and the ends of the armature. Additional pole spacing pieces can be present on the single coil bodies above the respective working air gaps.

BRIEF DESCRIPTION OF THE DRAWINGS

The present invention shall be explained in greater detail on the basis of an embodiment thereof shown in the drawings.

DESCRIPTION OF THE PREFERRED EMBODIMENTS

Figure 1:
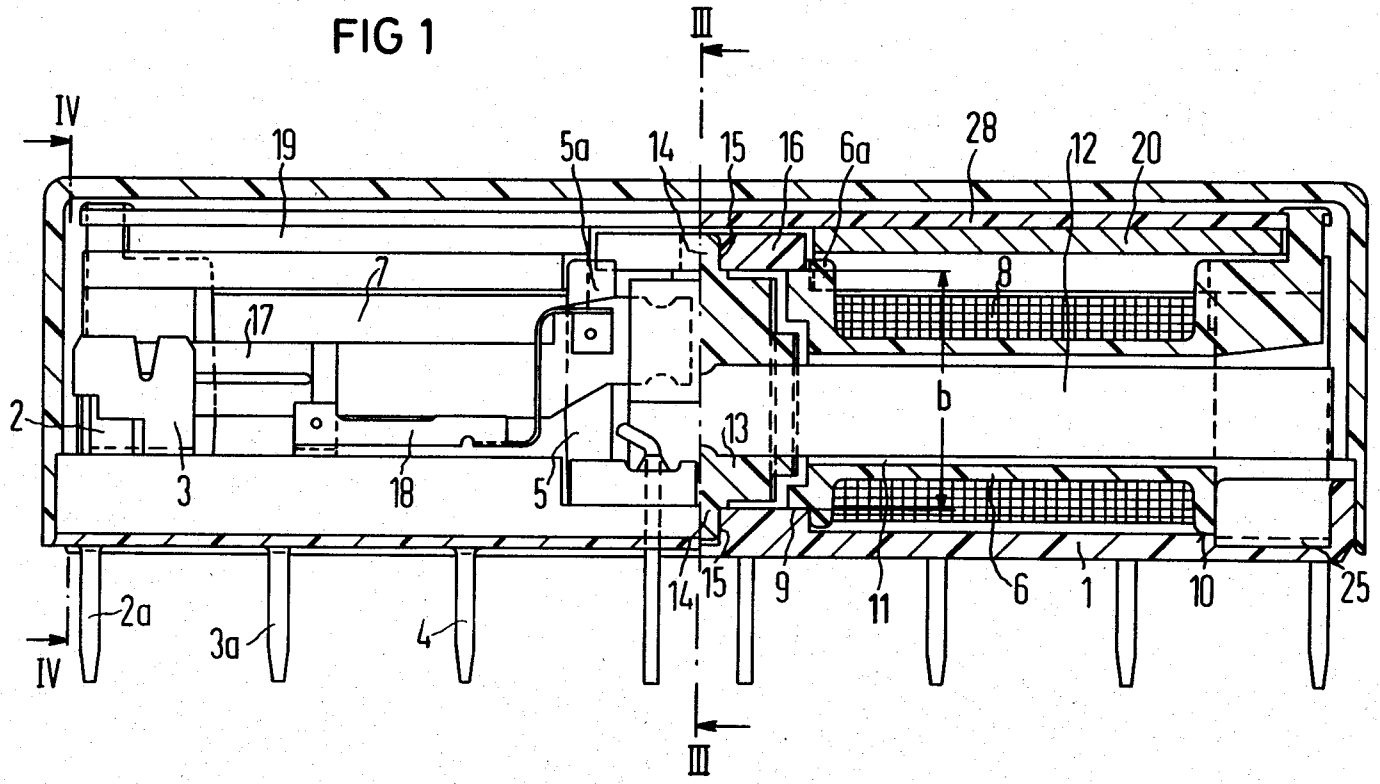
FIG. 1 is a side elevational view, partly in cross section, of an improved relay according to the present invention.
Figure 2:
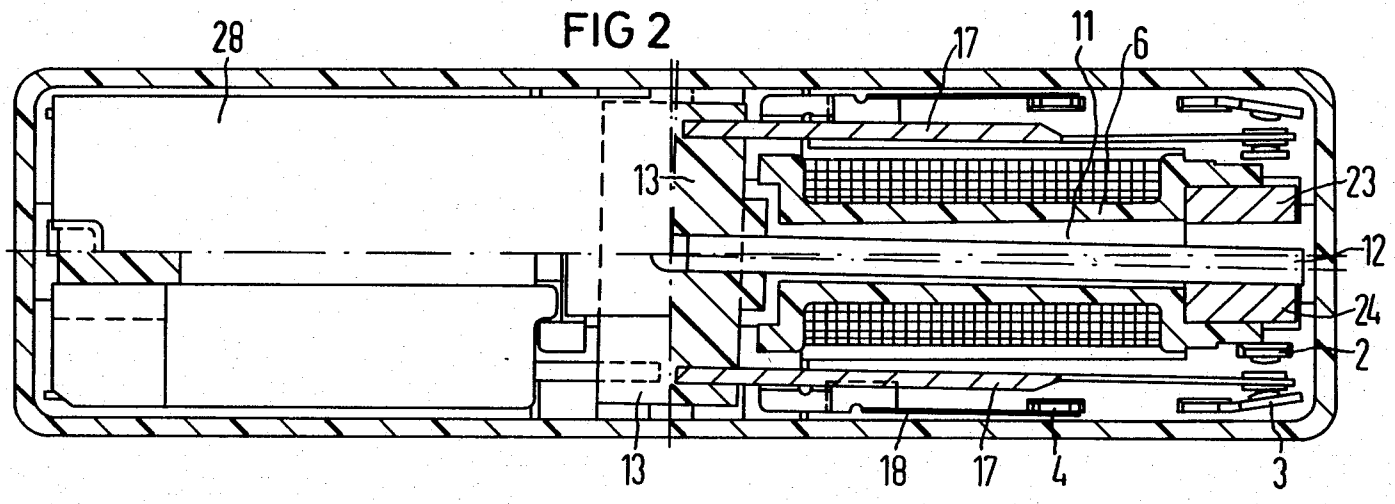
FIG. 2 is a cross-sectional view of the relay shown in FIG. 1.
Figure 5:
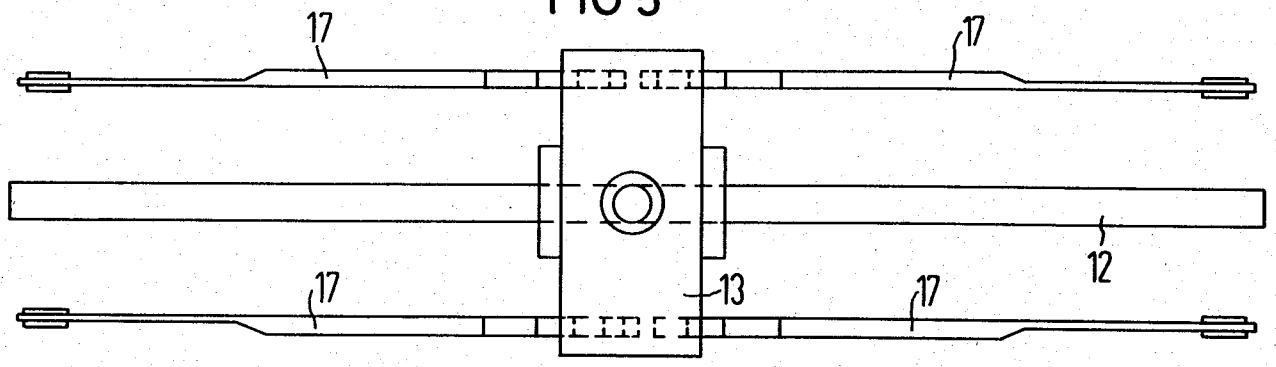
FIG. 5 is a plan view of an armature assembly of the type used in this embodiment.
Figure 3:
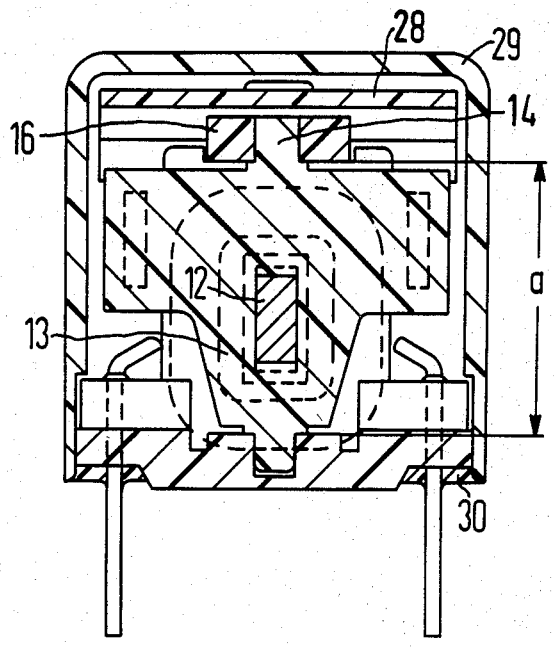
FIG. 3 is a cross-sectional view taken substantially along the line III—III of FIG. 1.

The relay illustrated in FIGS. 1 to 4 comprises a base body or pedestal 1 on which there are mounted cooperating contact elements 2 and 3 whose terminal pins 2*a* and 3*a*, respectively, as well as connecting elements 4 for the center contact springs are anchored by injection. Two individual hollow coil bodies 5 and 6 having windings 7 and 8 are disposed on the base 1 offset relative to one another in the axial direction. The coil bodies are positioned relative to the base 1 and relative to one another by means of seating shoulders 9 formed in the base together with seating surfaces 10. A beam rotating armature 12 whose central area is extrusion coated to provide a bearing element 13 extends through the hollow cores 11 of the two coil bodies in an approximately axial direction. By means of bearing neck portions 14, the bearing element 13 together with the armature 12 are seated in bearing bushings 15 in the base 1 and in a sole plate 16 as seen in FIG. 3. The sole plate 16 extends parallel to the base 1 on mutually facing flanges 5*a* and 6*a* of the two coil bodies 5 and 6 and simultaneously positions these two coil bodies relative to each other. Also embedded in the bearing element 13 parallel to the armature 12 are four center contact springs 17 best shown in FIG. 5. These extend laterally from the two coils and are arranged to engage a pair of cooperating contact elements 2 and 3. The center contact springs 17 are connected by means of a flexible conductor element 18 to an adjoining connector element 4 in the base 1.

Figure 4:
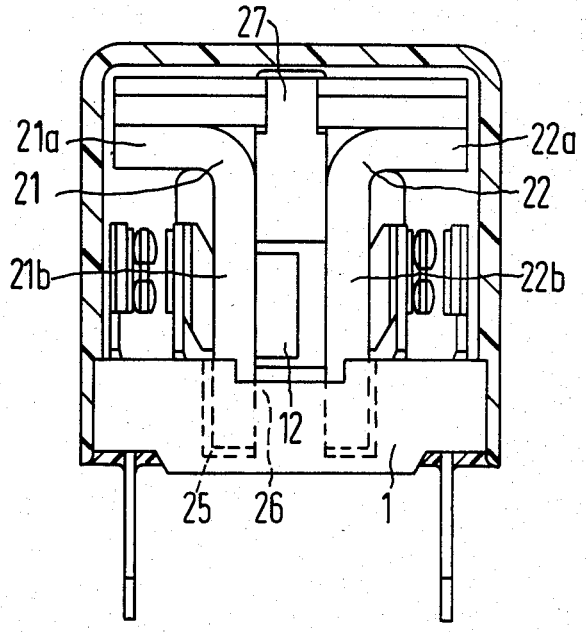
FIG. 4 is a cross-sectional view taken substantially along the line IV—IV of FIG. 1.

Four-pole magnet assemblies 19 and 20 are disposed above each of the two coil bodies 5 and 6, respectively. A pair of angular yokes 21,22 and 23,24 are coupled to the undersides of the magnets. The horizontal sections, for example, 21*a* and 22*a* of the yokes rest against a pole of a permanent magnet such as magnet 19. Vertical sections such as 21*b* and 22*b* shown in FIG. 4 form working air gaps with an end of the armature 12. The perpendicular ends of the yokes, for example, 21*b* and 22*b*, are inserted in recesses 25 of the base 1 so that a pole distancing piece 26 is formed by the base 1 between the yokes residing opposite one another in pairs, the pole distancing piece 26 exactly defining the width of the air gaps. A second pole distancing piece 27 is applied to the coil body as seen in FIG. 4. This structure provides an exact allocation of the seating surfaces of the armature and yokes as well as the contact locations of the center contact springs 17 connected to the armature and the cooperating contact elements 2 and 3 anchored in the base 1.

A low tolerance, precision assembly of the armature bearing 13 also exists in that the sole plate 16 is first loosely mounted to the armature and after magnetization of the permanent magnets, the armature is allowed to rest against two diagonally opposite pole shoes due to the permanentmagnet retaining forces. Subsequently, the sole plate 16 is secured to the coil body flanges 5*a* and 6*a* by means of bonding or by means of thermal deformation. The dimensions indicated by "a" of the bearing element 13 and "b" of the coil bodies 5 and 6 are such that no interference which would impede the rotary motion of the armature arises.

A flux guide plate 28 is disposed above the two permanent magnets 19 and 20. The magnetic circuit of the relay can be made either monostable or bistable by means of a corresponding magnetization of the permanent magnet regions, as discussed in the aforementioned German application. The relay is closed by means of a housing cap 29 inverted over the base body 1 and is sealed from below by means of a casting resin 30.

It should be evident that various modifications can be made to the described embodiments without departing from the scope of the present invention.

I claim as my invention:

1. An electromagnetic rotating armature relay comprising:

a base, a pair of hollow coil bodies in axial alignment along said base, a beam rotating armature extending axially through the insides of said coil bodies, a bearing element of insulating material disposed centrally of said armature, said bearing element having a first neck portion received in said base, a sole plate connecting said pair of coil bodies, said bearing element having a second neck portion received in said sole plate, a yoke at each end of the armature and forming a working air gap therebetween, and a pair of permanent magnets actuating said yoke and disposed above said coil bodies.

2. A relay according to claim 1 which includes:

contact springs having portions embedded in said bearing element and extending outwardly in spaced relation to said armature.

3. A relay according to claim 1 wherein said base has recesses therein receiving said yokes therein to define said working air gaps.

4. A relay according to claim 1 which includes pole distancing pieces on said base for positioning said yokes.

5. A relay according to claim 4 which includes:

additional pole distancing pieces on said coil bodies above the working air gap.

6. A relay according to claim 1 wherein said coil bodies include mutually facing flanges and said sole plate is bonded to said flanges.

* * * * *